US006061925A

United States Patent [19]

Amano et al.

[11] Patent Number: 6,061,925

[45] Date of Patent: May 16, 2000

[54] ROTARY TYPE HEAT TREATMENT DEVICE, AND TEMPERATURE CONTROL METHOD FOR THE DEVICE

[75] Inventors: Takuya Amano, Saitama; Akira Kondo, Tokyo; Ken Takizawa, Toyama, all of Japan

[73] Assignee: Japan Energy Corporation, Tokyo, Japan

[21] Appl. No.: 09/134,816

[22] Filed: Aug. 17, 1998

[51] Int. Cl.[7] ..... F26B 11/02

[52] U.S. Cl. ..... 34/141; 422/209

[58] Field of Search ..... 34/493, 495, 499, 34/576, 588, 589, 63, 135, 140, 141, 142; 432/103, 106; 422/209, 210

[56] References Cited

U.S. PATENT DOCUMENTS

| | | | |
|---|---|---|---|
| 3,896,556 | 7/1975 | Welter | 34/344 |
| 3,940,199 | 2/1976 | Ecklund | 339/6 |
| 5,312,599 | 5/1994 | Schwartz, Jr. | 422/209 |

*Primary Examiner*—Pamela A. Wilson

*Attorney, Agent, or Firm*—Sughrue, Mion, Zinn, Macpeak & Seas, PLLC

[57] ABSTRACT

An object of the invention is to provide a rotary type heat treatment device wherein, when a material to be sintered is continuously and stably sintered in a container, the material in the container is stably detected for a long period of time, and a temperature control method for the device. In order to perform temperature control with high accuracy, the inside of a container 6 is divided with screws 18 into temperatures control regions (1) through (6). Heat-resisting protective tubes 20, which are provided on the inner cylindrical wall of the container in such a manner that they are juxtaposed, and complementary thermocouples, are extended to the respective temperature control regions and are bent laterally. The temperature detecting sections 25 of the thermocouples that are led out of the protective pipes 20 are covered with heat-resisting material, and transmit electrical signals outside through a current collecting section consisting of a slip ring and brushes. The shift in temperature measuring position of the thermocouples is positively prevented. In addition, the thermocouples are prevented from being damaged; that is, they are prevented from being brought into contact with the inner cylindrical wall of the container. With the device, the sintering operation can be continuously and stably carried out for a long period of time.

37 Claims, 4 Drawing Sheets

ROTARY TYPE HEAT TREATMENT DEVICE, AND TEMPERATURE CONTROL METHOD FOR THE DEVICE

BACKGROUND OF THE INVENTION

This invention relates to a rotary type heat treatment which heat-treats a material, and to a temperature control method for the device. In the invention, the term "heat treatment" is intended to mean the drying or sintering treatment of a material. Hence, the invention is useful for continuously and stably drying or sintering a material.

Heretofore, in order to continuously dry or sinter a material containing moisture, a variety of drying devices or sintering devices such as "a dryer" or "a calciner" are used. Those devices are each a continuous rotary type device made up of a cylindrical or polygonal pipe shaped container which is laid horizontally so as to be rotated or swung. In the container, a thermocouple is provided to measure the drying temperature of a material to be dried or the sintering temperature of a material to be sintered. More specifically, in the rotation center portions of both ends of the container or in the rotation center portion of the tail of the container, a steel material is fixedly laid which is long enough to reach the region where the drying or sintering operation is carried out in the container. From the steel material, the thermocouple is suspended, and it is surrounded by the material which is at a temperature measuring position.

The long steel material, from which the thermocouple is suspended, is exposed to a high temperature atmosphere in the drying region or sintering region in the container. While the operation is carried out for a long time, the long steel material is gradually thermally deteriorated, so that its mechanical strength is lowered, and may be bent. If this trouble occurs, the thermocouple is shifted, so that it becomes impossible to measure the temperature of the material at the aimed (intended) part thereof. At worst, the end of the thermocouple is caused to directly contact the inner surface of the container, so that the thermocouple may be broken.

In order to prevent the thermocouple-suspending steel material from breaking, the following method is employed: That is, a necessary number of means are set in the container which are designed as follows: The suspending steel material is inserted in a cylinder which is larger than the former (the suspending steel material). The cylinder is permanently positioned at the rotation center portion of the container with several supporting steel materials which are extended in different directions in the container.

However, the method is disadvantageous in the following points: The thermocouple-suspending steel material, and the supporting cylinder are exposed to the high temperature atmosphere, and the supporting cylinder and the suspending steel member are brought into contact with each other, thus being worn out. That is, it is impossible for the method to stably perform the temperature detection for a long time.

SUMMARY OF THE INVENTION

Accordingly, an object of the invention eliminates the above-described difficulties. More specifically, an object of the invention is to provide a rotary type heat treatment device which is able to stably detect the temperature of a material to be treated that is provided inside the container, and is able to prevent the damage of the thermocouple that attributes to the direct contact of the inner surface of the container, thereby to continuously and stably thermally treat the material to be treated for a long time, and a temperature control method in the rotary type heat treatment device.

A rotary type heat treatment device of the present invention comprises a container rotated around a central axis laid substantially horizontally to heat-treat a material to be heat-treated therein; protective tubes mounted on an inner cylindrical surface of the container; thermocouples positioned in the protective tubes; and a current corrector section for leading electrical signals out of the container which are produced by the thermocouples.

DETAILED DESCRIPTION OF THE PREFERRED EMBODIMENTS

One preferred embodiment of the invention will be described with reference to FIGS. 1 through 4. A rotary type heat treatment device 1 of the present invention (hereinafter referred to as "a heat treatment device 1", when applicable) is used to heat-treat (dry or sinter) a material to be treated such as catalyst.

Figure 1:
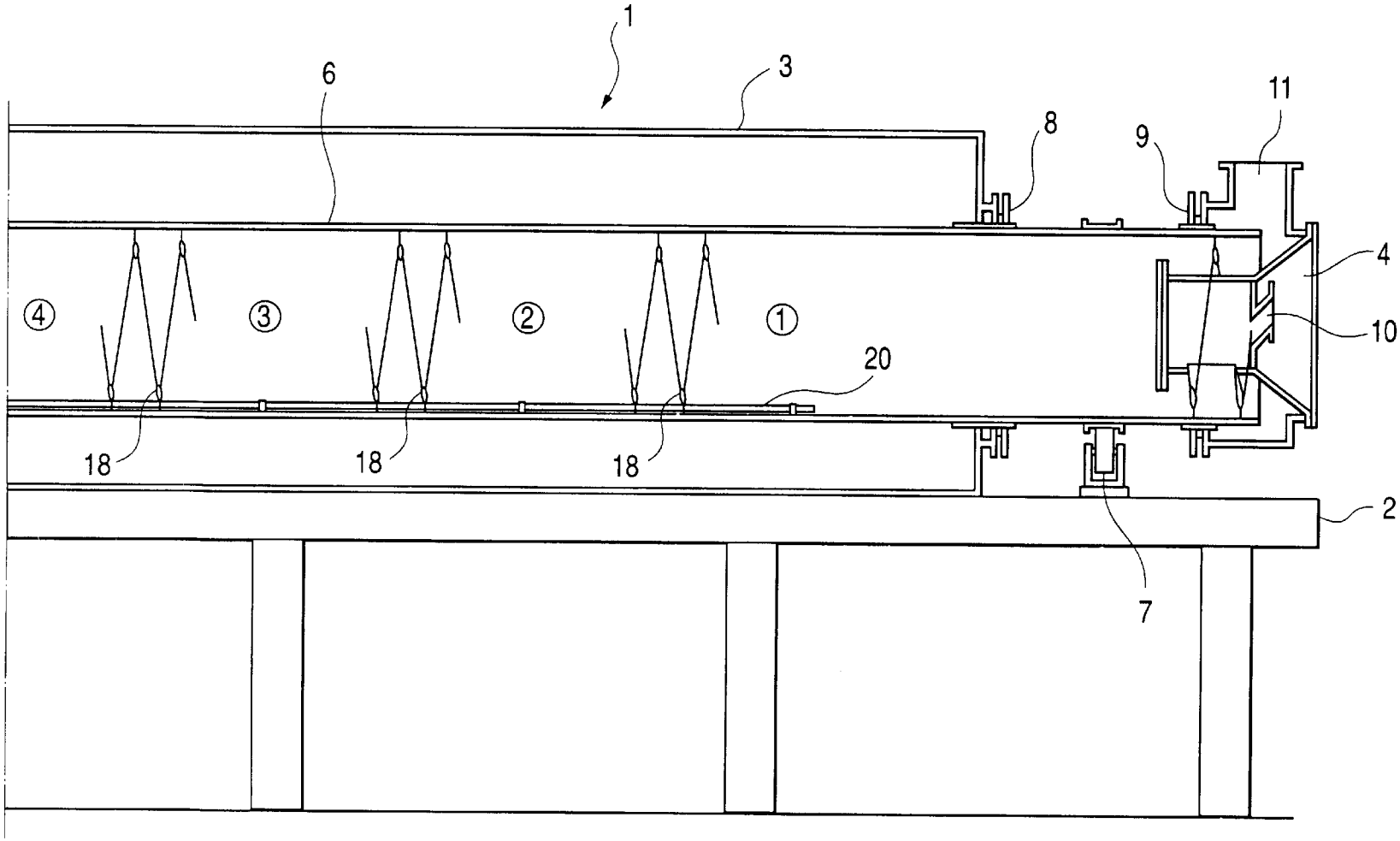
FIG. 1 is the right half of a longitudinal sectional view of a rotary type heat treatment device according to the present invention.
Figure 2:
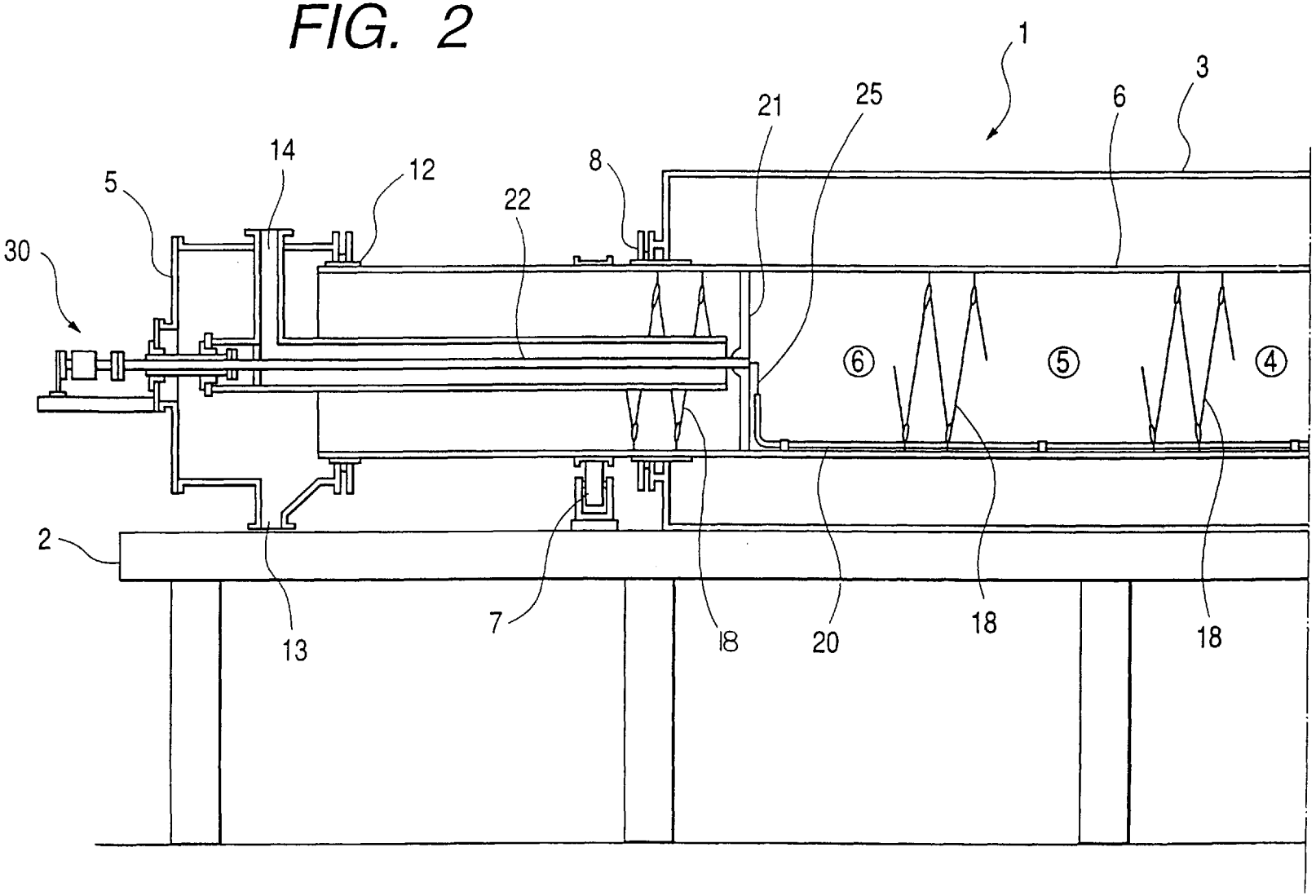
FIG. 2 is the left half of the longitudinal sectional view of the rotary type heat treatment device according to the present invention.

FIG. 1 is the right half of a longitudinal sectional view of the heat treatment device 1 of the present invention, and FIG. 2 is the left half of the same. The heat treatment device 1 comprises a frame (or stand) 2; a combustion furnace 3 fixedly mounted on the frame 2; a raw material supply section 4 and a raw material discharge section 5 which are fixedly secured to the stationary portion of the device; and a cylindrical container 6 which is rotatably provided between the raw material supply section 4 and the raw material discharge section 5.

An electric motor (not shown) to drive the container 6, and at least two rollers 7 supporting the container 6 are mounted on the frame 2. More specifically, the container 6 is rotatably mounted to rollers 7, and is turned as the motor (not shown) rotates.

As shown in FIGS. 1 and 2, the container 6 is a cylinder whose both ends are open. The container 6 penetrates the combustion furnace 3; that is, the part of the container 6 except both end portions is in the combustion furnace 3, thus being heated. The container 6 and the combustion furnace 3 are sealed with right and left slide sections 8, so that the combustion gas in the combustion furnace 3 is prevented from leaking through the slide sections between the container 6 and the combustion furnace 3.

As shown in FIG. 1, the right end portion of the container 6 is rotatably supported by the raw material supply section 4. The container 6 is in slide contact with the slide section 9. Since the container 6 and the raw material supply section 4 are seal with the slide section 9, the gas in the container 6 will not leak therefrom. The raw material supply section 4 has a raw material supply (let-in) section 10 so as to supply raw material into the container 6. An exhaust pipe 11 is provided on the raw material supply section 4.

As shown in FIG. 2, the left end portion of the container 6 is rotatably supported by the raw material discharge section 5. The container 6 is in slide contact with the slide section 12. Since container 6 and the raw material discharge section 5 are sealed with the slide section 12, the gas in the container 6 will not leak therefrom. A discharge outlet 13 for discharging the material which has been heat-treated is formed on the under surface of the raw material discharge section 5.

As shown in FIGS. 1 and 2, a plurality of screws 18 are provided at suitable intervals in the container 6. Those screws 18 function to adjust the amount of movement of a material to be heat-treated in the container 6, and to serve as partition walls to divide the content (inside) of the container into a plurality of temperature control regions.

A plurality of thermocouples are provided inside the container 6. The number of thermocouples is equal to the number of temperature control regions in the container 6. The temperature detecting section of each of the thermocouples is set in the respective temperature control region to detect the temperature of the latter.

Figure 3:
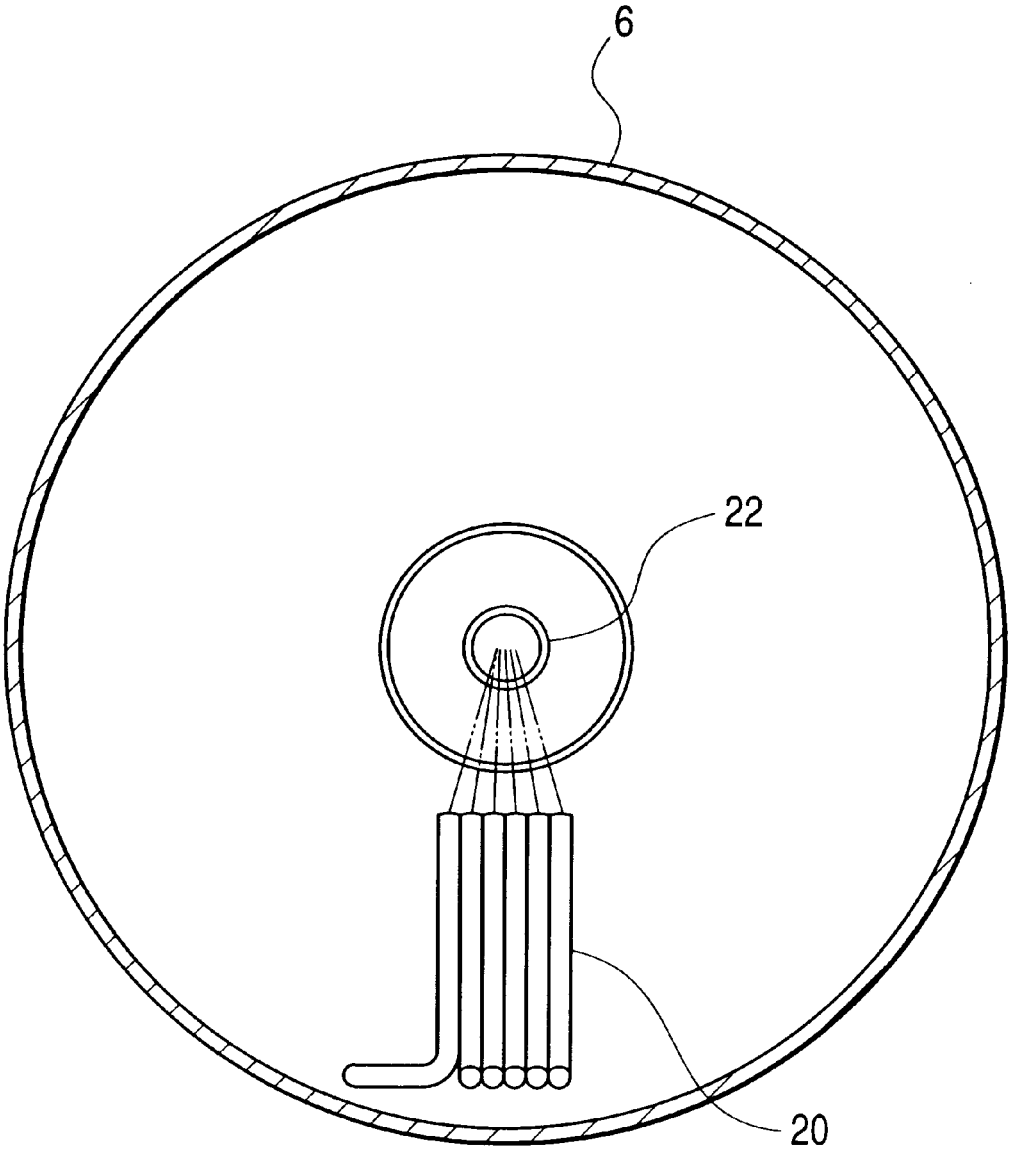
FIG. 3 is an explanatory sectional view showing protective pipes arranged in the container of the rotary type heat treatment device according to the present invention.

Each of the thermocouples is positioned inside a heat-resisting protective tube 20 so that it is protected from a material to be heat-treated in the container 6 and a high-temperature atmosphere. As shown in FIG. 3, a plurality of protective tubes 20 are juxtaposed on the inner cylindrical surface of the container 6 in such a manner that they are extended in parallel with the longitudinal direction of the container 6. The temperature detecting section of each of the thermocouples is extended from the end of the respective protective tube 20, and is bent in such a manner that the end of the temperature detecting section is at a predetermined distance from the inner cylindrical surface of the container 6. That is, the thermocouples are spaced a predetermined distance from the inner cylindrical surface of the container 6 to measure the temperatures at the respective temperature control regions in the container 6.

In the embodiment, six screws 18 are provided in the container 6 to provide six temperature control regions (1) through (6), and the temperatures of the temperature control regions (1) through (6) are precisely measured with the six thermocouples accommodated in the protective tubes 20, so that the results of detection are utilized to control the temperatures of the regions (1) through (6).

Figure 4:
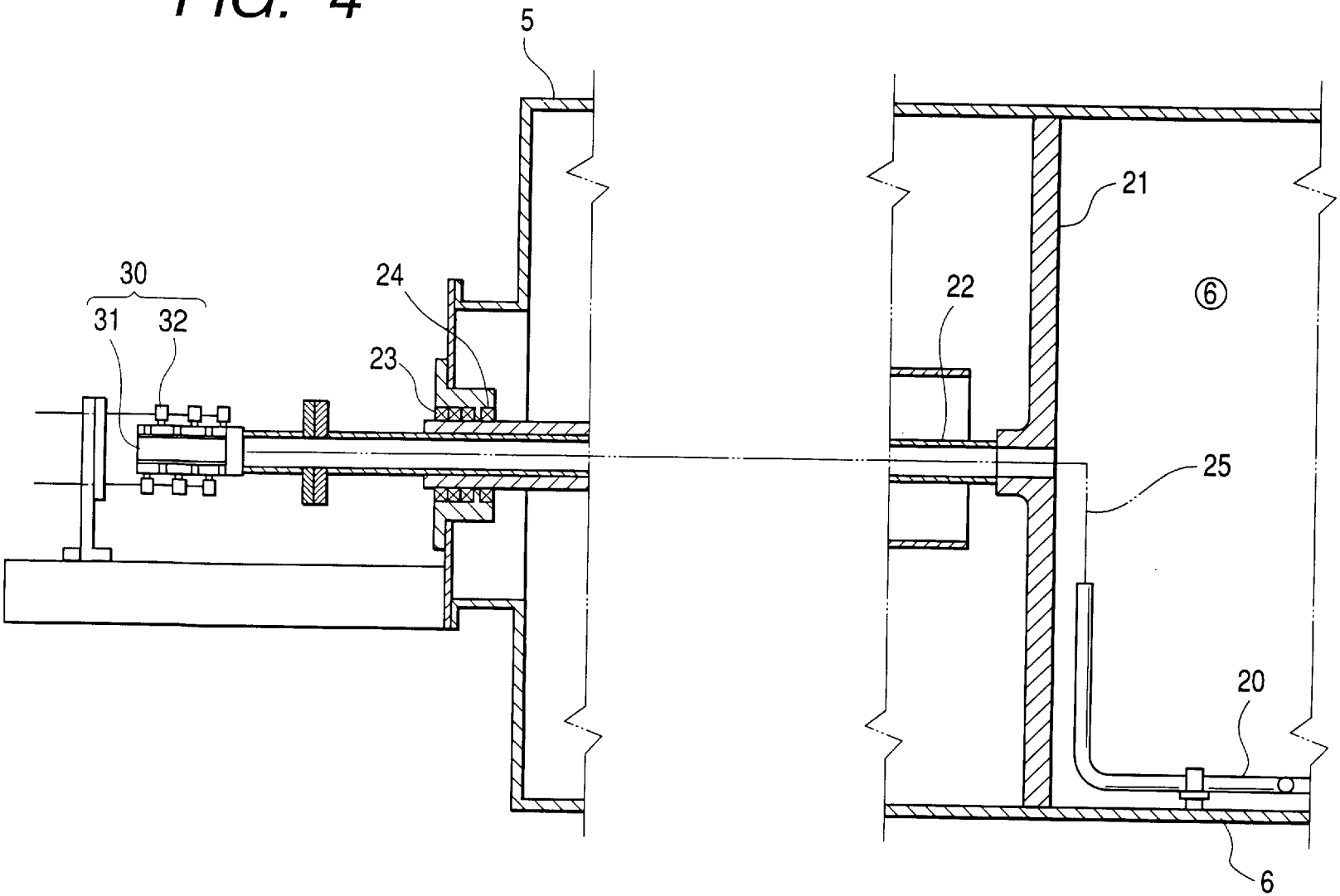
FIG. 4 is an enlarged sectional diagram showing the rear end portion of protective pipes and a current collector section and its relevant components in the rotary type heat treatment device of the present invention.

As shown in FIG. 4, in the temperature control region (6) nearest the raw material discharge section 5, a support spoke 21 is fixedly secured to the inner cylindrical surface of the container 6. A hollow pipe 22 is fixed to the center of the support spoke 21. The hollow pipe 22 penetrates the raw material discharge section 5 air tight and rotatably through a bearing 23 and a seal 24, and extends outside. The hollow pipe 22 is smoothly rotatable, and the gas produced in the container 6 will not leak out through the slide section of the hollow pipe 22.

The rear end portion of the protective tube 20 is bent substantially at a right angle extending along the support spoke 21 near to the center of rotation of the container 6. A conductor unit 25 of each of the thermocouple, which is covered with a heat-resisting material are protruded from the open rear end of the protective pipe 20. An electrical signal from the thermocouple is detected by a current corrector section 30. In the embodiment, the current corrector section 30 comprises a slip ring 31 that is a rotary member which is coupled to the conductor units of the thermocouples and is rotated together with the container 6; and brushes 32 that is contact means which contact the slip ring 31 to detect electrical signals. The conductor units 25 are extended through the hollow pipe 22 secured to the center of the support spoke 21, and are connected to the slip ring 31 secured to the end of the hollow pipe 22. The six conductor units 25 of the six thermocouples are led collectively to the one slip ring 31 and coupled to the respective contact parts of the latter 31. And, the six brushes 32 are in contact with the contact parts of the slip ring 31, respectively. Hence, the electrical signals produced by the six thermocouples provided in the container 6 are led to the slip ring 31, and are detected with the brushes 32. The electrical signals thus detected are utilized to detect the temperatures of the temperature control regions (1) through (6), and the temperature in the container 6 is controlled according to the results of detection.

The operation of the rotary type heat treatment device thus constructed will be described.

The motor is drive to turn the container 6 at a predetermined speed, while the combustion furnace 3 is started, so as to heat the container 6 to a predetermined temperature. Under this condition, a predetermined amount of material to be heat-treated is supplied through the raw material supply section 10 of the raw material supply section 4. The material thus supplied is heat-treated (dried or sintered) while being agitated, and conveyed to the raw material discharge section with the aid of the screws 18.

In the rotary type heat treatment device of the invention, the thermocouples are substantially covered with the protective tubes 20, and the conductor units 25 extended from the rear ends of the protective tubes 20 are covered with the protective covers. Hence, the thermocouples are scarcely damaged by the high temperature atmosphere in the container 6 or the material to be heat-treated in the same 6. The thermocouples are positioned in the protective tubes 20, and the end portions of the latter 20 are bent so that the temperature detecting portions of the thermocouples are located at a predetermined distance from the inner cylindrical surface of the container. Therefore, in the temperature control regions, the temperature measuring positions are stable for a long time. The above-described features make it possible to stably detect the temperatures of the materials in the temperature control regions for a long time, and to perform temperature control with high accuracy.

In the rotary type heat treatment device of the present invention, the thermocouple suspending steel members and the middle supporting cylinder which are employed in the prior art, are not used in the device of the invention and only the front end portions of the thermocouples are exposed from the front ends of the protective tubes which are covered with the material which is high in wear resistance, thermal conduction, and corrosion resistance, and the protective tubes covering the conductor units of the thermocouples are mounted directly on the inner cylindrical surface of the container. Hence, the temperature of the material in the container can be stably measured for a long time.

That is, in order to accurately control the heat treatment temperature inside the container, it is essential to detect the temperature of the material to be heat-treated at a predetermined position, while it is necessary to stably position the ends of the thermocouples at the predetermined position for a long time which is measured in the direction of depth of the material to be. In the invention, the thermocouples are positively prevented from being shifted, and they are prevented from being damaged by being brought directly into contact with the inner cylindrical surface of the container. Hence, with the rotary type heat treatment device of the invention, the heat treatment can be performed continuously and stably for a long period of time.

What is claimed is:

1. A rotary type heat treatment device comprising:

a container rotated around a central axis extended substantially horizontal for heat-treating a material;

protective tubes mounted on an inner cylindrical surface of said containers ;

thermocouples positioned in said protective tubes; and a current corrector section for leading electrical signals out of said container which are produced by said thermocouples.

2. The rotary type heat treatment device of claim 1, wherein said protective tubes are mounted to extend in a longitudinal direction of said container, and front end portions of said protective tubes from which temperature detecting portions of said thermocouples are extended are bent to be at a predetermined distance from said inner cylindrical surface of said container.

3. The rotary type heat treatment device of claim 1, wherein conductor units of said thermocouples that are extended from rear end portions of said protective pipes to said current collector section are covered by heat-resisting material.

4. The rotary type heat treatment device of claim 1, wherein said current collector section comprises:

a rotary member rotated together with said container connected to conductor units of said thermocouples; and contact members in contact with said rotary member for obtaining said electrical signals.

5. The rotary type heat treatment device of claim 1 further comprising:

partition boards provided on said inner cylindrical surface of said container for dividing the inside of said container into a plurality of temperature control regions.

6. The rotary type heat treatment device of claim 5, wherein said partition boards are screws for conveying said material to be heat-treated as said container rotates.

7. The rotary type heat treatment device of claim 5, wherein there is one thermocouple positioned in each of said temperature control regions.

8. A temperature control method for a rotary type heat treatment device comprising a container extended substantially horizontal and rotated around a central axis extended substantially horizontal for heat-treating a material comprising:

dividing the inside of said container into a plurality of temperature control regions; and measuring temperatures of said temperature control regions with a plurality of thermocouples mounted on an inner cylindrical surface of said container for controlling the temperature of said container.

9. A rotary type heat treatment device comprising:

a container rotated around a central axis extended substantially horizontal for heat-treating a material;

protective tubes mounted on an inner cylindrical surface of said container;

thermocouples positioned in said protective tubes; and a current corrector section for leading electrical signals out of said container which are produced by said thermocouples, wherein said protective tubes are mounted to extend in a longitudinal direction of said container, and front end portions of said protective tubes from which temperature detecting portions of said thermocouples are extended are bent to be at a predetermined distance from said inner cylindrical surface of said container.

10. The rotary type heat treatment device of claim 9, wherein conductor unites of said thermocouples that are extended from rear end portions of said protective pipes to said current collector section are covered by heat-resisting material.

11. The rotary type heat treatment device of claim 9, wherein said current collector section comprises:

a rotary member rotated together with said container connected to conductor units of said thermocouples; and contact members in contact with said rotary member for obtaining said electrical signals.

12. The rotary type heat treatment device of claim 9 further comprising:

partition boards provided on said inner cylindrical surface of said container for dividing the inside of said container into a plurality of temperature control regions.

13. The rotary type heat treatment device of claim 12, wherein said partition boards are screws for conveying said material to be heat-treated as said container rotates.

14. The rotary type heat treatment device of claim 12, wherein there is one thermocouple positioned in each of said temperature control regions.

15. A rotary type heat treatment device comprising:

a container rotated around a central axis extended substantially horizontal for heat-treating a material;

protective tubes mounted on an inner cylindrical surface of said container;

thermocouples positioned in said protective tubes; and a current corrector section for leading electrical signals out of said container which are produced by said thermocouples, wherein conductor units of said thermocouples that are extended from rear end portions of said protective pipes to said current collector section are covered by heat-resisting material.

16. The rotary type heat treatment device of claim 15, wherein said protective tubes are mounted to extend in a longitudinal direction of said container, and front end portions of said protective tubes from which temperature detecting portions of said thermocouples are extended are bent to be at a predetermined distance from said inner cylindrical surface of said container.

17. The rotary type heat treatment device of claim 15, wherein said current collector section comprises:

a rotary member rotated together with said container connected to conductor units of said thermocouples; and contact members in contact with said rotary member for obtaining said electrical signals.

18. The rotary type heat treatment device of claim 15 further comprising:

partition boards provided on said inner cylindrical surface of said container for dividing the inside of said container into a plurality of temperature control regions.

19. The rotary type heat treatment device of claim 18 wherein said partition boards are screws for conveying said material to be heat-treated as said container rotates.

20. The rotary type heat treatment device of claim 18, wherein there is one thermocouple positioned in each of said temperature control regions.

21. A rotary type heat treatment device comprising:

a container rotated around a central axis extended substantially horizontal for heat-treating a material;

protective tubes mounted on an inner cylindrical surface of said container;

thermocouples positioned in said protective tubes; and a current corrector section for leading electrical signals out of said container which are produced by said thermocouples, wherein said current collector section comprises:

a rotary member rotated together with said container connected to conductor units of said thermocouples; and contact members in contact with said rotary member for obtaining said electrical signals.

22. The rotary type heat treatment device of claim 21, wherein said protective tubes are mounted to extend in a longitudinal direction of said container, and front end portions of said protective tubes from which temperature detecting portions of said thermocouples are extended are bent to be at a predetermined distance from said inner cylindrical surface of said container.

23. The rotary type heat treatment device of claim 21, wherein conductor units of said thermocouples that are extended from rear end portions of said protective pipes to said current collector section are covered by heat-resisting material.

24. The rotary type heat treatment device of claim 21 further comprising:

partition boards provided on said inner cylindrical surface of said container for dividing the inside of said container into a plurality of temperature control regions.

25. The rotary type heat treatment device of claim 24, wherein said partition boards are screws for conveying said material to be heat-treated as said container rotates.

26. The rotary type heat treatment device of claim 24, wherein there is one thermocouple positioned in each of said temperature control regions.

27. A rotary type heat treatment device comprising:

a container rotated around a central axis extended substantially horizontal for heat-treating a material;

partition boards provided on an inner cylindrical surface of said container for dividing the inside of said container into a plurality of temperature control regions;

protective tubes mounted on said inner cylindrical surface of said container;

thermocouples positioned in said protective tubes; and a current corrector section for leading electrical signals out of said container which are produced by said thermocouples.

28. The rotary type heat treatment device of claim 27, wherein said protective tubes are mounted to extend in a longitudinal direction of said container, and front end portions of said protective tubes from which temperature detecting portions of said thermocouples are extended are bent to be at a predetermined distance from said inner cylindrical surface of said container.

29. The rotary type heat treatment device of claim 27, wherein conductor units of said thermocouples that are extended from rear end portions of said protective pipes to said current collector section are covered by heat-resisting material.

30. The rotary type heat treatment device of claim 27, wherein said current collector section comprises:

a rotary member rotated together with said container connected to conductor units of said thermocouples; and contact members in contact with said rotary member for obtaining said electrical signals.

31. The rotary type heat treatment device of claim 27, wherein said partition boards are screws for conveying said material to be heat-treated as said container rotates.

32. The rotary type heat treatment device of claim 27, wherein there is one thermocouple positioned in each of said temperature control regions.

33. A rotary type heat treatment device comprising:

a container rotated around a central axis extended substantially horizontal for heat-treating a material;

partition boards provided on an inner cylindrical surface of said container for dividing the inside of said container into a plurality of temperature control regions;

protective tubes mounted on said inner cylindrical surface of said container;

thermocouples positioned in said protective tubes; and a current corrector section for leading electrical signals out of said container which are produced by said thermocouples, wherein said partition boards are screws for conveying said material to be heat-treated as said container rotates.

34. The rotary type heat treatment device of claim 33, wherein said protective tubes are mounted to extend in a longitudinal direction of said container, and front end portions of said protective tubes from which temperature detecting portions of said thermocouples are extended are bent to be at a predetermined distance from said inner cylindrical surface of said container.

35. The rotary type heat treatment device of claim 33, wherein conductor units of said thermocouples that are extended from rear end portions of said protective pipes to said current collector section are covered by heat-resisting material.

36. The rotary type heat treatment device of claim 33, wherein said current collector section comprises:

a rotary member rotated together with said container connected to conductor units of said thermocouples; and contact members in contact with said rotary member for obtaining said electrical signals.

37. The rotary type heat treatment device of claim 33, wherein there is one thermocouple positioned in each of said temperature control regions.

* * * * *